United States Patent [19]

Hopkins

[11] 4,277,358

[45] Jul. 7, 1981

[54] ENVIRONMENTALLY DEGRADABLE SOAP BAR SYSTEM

[76] Inventor: Lamar Hopkins, R.D. #1, Norristown, Pa. 19401

[21] Appl. No.: 76,684

[22] Filed: Sep. 19, 1979

Related U.S. Application Data

[63] Continuation-in-part of Ser. No. 763,233, Jan. 27, 1977, abandoned.

[51] Int. Cl.[3] ..... C11D 9/26; C11D 10/06; C11D 17/04

[52] U.S. Cl. ..... 252/92; 252/134; 252/174; 252/DIG. 16

[58] Field of Search ..... 252/90, 92, 134, 174, 252/DIG. 16

[56] References Cited

U.S. PATENT DOCUMENTS

| | | | |
|---|---|---|---|
| 108,584 | 10/1870 | George | 252/92 |
| 648,247 | 4/1900 | Dunne | 252/92 |
| 1,707,334 | 4/1929 | Unfried | 252/92 |
| 1,997,474 | 4/1935 | Stone | 252/92 |
| 3,413,229 | 11/1968 | Bianco | 252/90 |
| 3,773,672 | 11/1973 | Bredice | 252/92 |

FOREIGN PATENT DOCUMENTS

| | | | |
|---|---|---|---|
| 835913 | 3/1970 | Canada | 252/91 |
| 881767 | 11/1961 | United Kingdom | 252/92 |

*Primary Examiner*—Dennis L. Albrecht
*Attorney, Agent, or Firm*—Morton J. Rosenberg

[57] ABSTRACT

An environmentally degradable soap bar system (10) which includes a degradable insert member (14) centrally positioned and molded internal to a soap bar (12). The degradable insert member (14) is generally formed from a water soluble plastic composition, which may be selected from a group consisting of polyvinyl alcohol, hydroxypropyl cellulose, and polyethylene oxide. The degradable insert member (14) is substantially planar in contour and includes a plurality of through openings (24). Soap material is molded around the degradable insert member (14) and within the through openings (24). The soap material molded within the through openings (24) secures the degradable insert member (14) to the surrounding soap material and provides a mechanism for securing the degradable insert member (14) to the soap bar (12) independent of wear orientation imposed on the soap bar (12) during use. Subsequent to use, the degradable insert member (14) may be disposed of by generally dissolving the degradable insert member (14) in an aqueous solution.

8 Claims, 4 Drawing Figures

FIG. 1
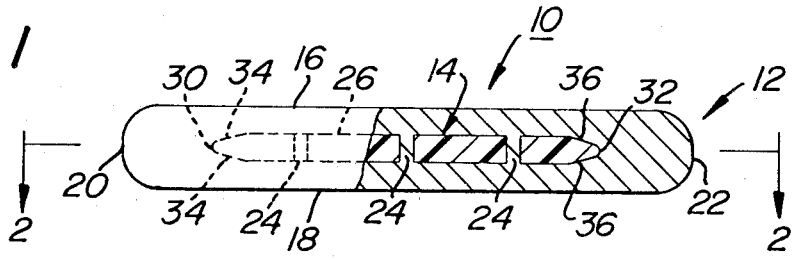
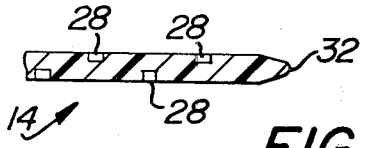
FIG. 4
FIG. 2
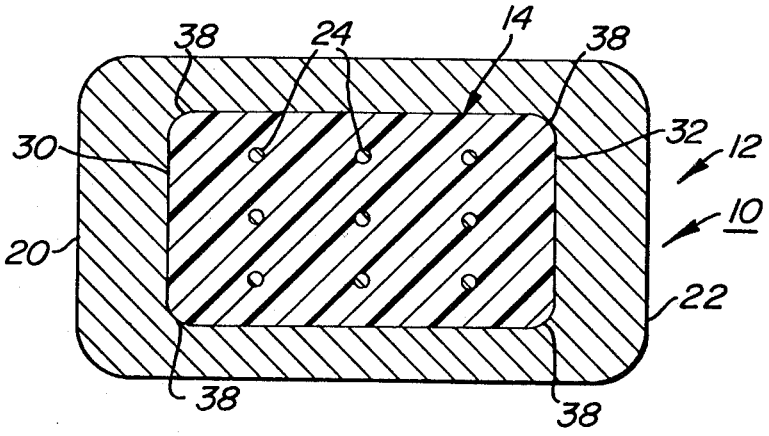
FIG. 3
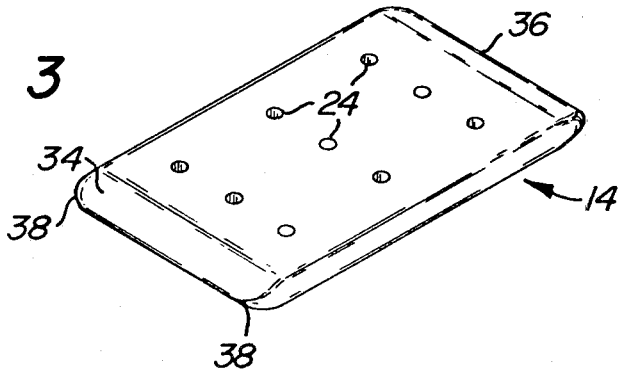

ENVIRONMENTALLY DEGRADABLE SOAP BAR SYSTEM

REFERENCES TO RELATED APPLICATIONS

This Patent Application is a continuation-in-part of U.S. Patent Application Ser. No. 763,233, filed on Jan. 27, 1977, now abandoned.

BACKGROUND OF THE INVENTION

1. Field of the Invention

This invention relates to environmentally degradable soap bar systems. In particular, this invention relates to a totally environmentally degradable soap bar system which allows maximum use of soap materials forming soap bars, while minimizing inconvenience to the user in disposing of those portions of the soap bar system, which are not formed of soap material. More in particular, this invention relates to an environmentally degradable insert member which is positionally located within a soap bar. Further, this invention relates to an environmentally degradable insert member having through openings within which soap material is molded for securing the insert member to the surrounding soap material. More in particular, this invention relates to an environmentally degradable insert member formed from a water soluble plastic composition, which when immersed in an aqueous solution, dissolves and may be disposed of through the normal drain system of a household. Still further, this invention relates to an environmentally degradable soap bar system where the insert member includes a composition selected from the group consisting of polyvinyl alcohol, hydroxypropyl cellulose, and polyethylene oxide.

2. Prior Art

In some prior soap bars, wear on the soap during use results in the fragmentation of the prior soap bars after a substantial volume of the soap material has been used. Such fragmentation has led to small quantities of soap material being wasted by the user.

In some prior art soap bar systems, insert members have been provided within a particular bar of soap. The best prior art known to applicant includes those systems shown in U.S. Pat. Nos. 1,997,474; 3,773,672; 1,707,334; and, within Great Britain Patent No. 881,767, as well as Canadian Patent No. 835,913.

However, in some of the prior art soap bar systems, such is found not to include mechanisms where the insert members were secured to the surrounding soap material. Thus, in such prior soap bar systems, the insert member after substantial use, could be easily removed from the bar of soap. In some cases, this led to cavities formed within the remaining bar of soap, which eventually led to disintegration and fragmentation of the remaining soap bar volume after further use. This had the disadvantage of wasting soap material.

In other prior art soap bar systems, the insert member was not contoured to provide rounded edges. Where sharp edges were provided in such insert members, after substantial use and wearing away of the soap material surrounding the insert member, the user had the possibility of basically injuring himself/herself when being contiguously rubbed on the epidermis.

In the prior art systems known to the applicant, the soap bar systems were not environmentally degradable. Insert members were not formed from a water soluble plastic composition which minimizes the disposal problems of the insert member subsequent to use.

SUMMARY OF THE INVENTION

An environmentally degradable soap bar system, which includes a soap bar having a predetermined contour. An insert member formed of an environmentally degradable composition is positionally located internal to the soap bar. Additionally, a mechanism for securing the insert member to the soap bar independent of wear orientation imposed on the soap bar during use is provided.

An object of the present invention is to provide an environmentally degradable soap bar system, which permits the user to utilize a maximum volume of soap material making up the soap bar.

Another object of the subject invention is to create an environmentally degradable soap bar system, which may be easily disposed of subsequent to the use of the soap material.

A still further object of the invention is to provide a soap bar system which includes an insert member formed from a water soluble plastic composition which may be dissolved and disposed of through the normal drain system of a household.

A still further object of the instant invention is to provide an environmentally degradable soap bar system having an insert member formed of a composition selected from the group consisting of polyvinyl alcohol, hydroxypropyl cellulose, and polyethylene oxide.

Another object of the invention is to create an environmentally degradable soap bar system, where a maximum amount of soap material is utilized and a minimal amount of soap material is necessarily discarded by the user.

A still further object of the instant invention is to provide an environmentally degradable insert member which is bonded to the surrounding soap material subsequent to a substantial volume of the soap material being consumed and is degradable upon eventual contact with an aqueous solution.

Another object of the present invention is to provide an environmentally degradable insert member for a bar of soap which is specifically contoured in order to minimize sharp edges in order that abrasive contact with the skin of a user will not injure the user.

BRIEF DESCRIPTION OF THE DRAWINGS

FIG. 1 is an elevational view partially cut-away, showing the soap bar system having a centrally positioned insert member;

FIG. 2 is a sectional view of the soap bar system taken along the section lines 2—2 of FIG. 1;

FIG. 3 is a perspective view of the insert member; and,

FIG. 4 is a cut-away elevational view of the insert member, showing an embodiment of the invention where partial recesses are formed in opposing surfaces of the insert member.

DESCRIPTION OF THE PREFERRED EMBODIMENTS

Referring now to FIGS. 1 and 2, there is shown environmentally degradable soap bar system 10, which allows the user to utilize a major portion of the entire volume of soap bar 12. Use of environmentally degradable soap bar system 10 prevents the rupture of a bar of soap after significant portions of the volume have been worn away. Additionally, subsequent to the use of the soap material, the overall composition of the remaining portion of system 10 may be easily disposed of, as will be discussed in following paragraphs. In overall concept, degradable soap bar system 10 allows the user to maximize the amount of soap material for the purposes intended, while minimizing the amount of soap material waste, which is generally discarded in conventional soap bars when the soap has been reduced to a thin or sliver residue.

Additionally, environmentally degradable soap bar system 10 is specifically advantageous in commercial establishments, where the use of the soap bar 12 is only utilized a discrete number of times and then discarded. Such establishments include soap which is provided by motels and hotels, and are replaced each day or when a new guest rents a room. In such cases, large quantities of soap may be wasted, since such soap material is generally not recycled.

Still further, environmentally degradable soap bar system 10 includes the advantage of maintaining the various elements of the overall system in secured attachment throughout the use period of soap bar 12, and even when the soap material volume is reduced by a substantial amount. Subsequent to use of all of the soap material, the user is left with an element contoured in a predetermined manner, such that there is a minimization of sharp edges of remaining elements in order that complete safety is provided throughout the use time cycle of degradable soap bar system 10. Further, the specific composition of the remaining element is extremely important, in that such is degradable and usually disposed of by the user subsequent to use.

Environmentally degradable soap bar system 10 includes soap bar 12, which is molded into a cake-like element, as is shown in the Figures. Soap bar 12, having the predetermined contour of a bar of soap, is generally formed of a compound of one of the higher fatty acids or a mixture of such compounds.

The soap material is well-known in the art, and may be salts of the alkali metals, and are generally soluble in water. However, the soap material as herein provided may be extended to include salts of other metals, some of which may be soluble in water, combinations of fatty acids, and predetermined organic bases, such as ethanolamine, and/or mixtures of the foregoing substances with alkaline silicates, glycerol, and other additives.

Such soap materials are well-known in the art, and for the purposes of the inventive concept, as is herein described, such soap material may be any one of a number of varieties of chemical compositions, examples of which have hereinbefore been detailed.

In general, soap bars 12 of the type herein described, are molded into a predetermined contour through molding techniques, not important to the inventive concept, as is herein described. Degradable soap bar system 10 further includes insert member 14, which is positionally located internal to soap bar 12. The soap material forming the chemical composition of soap bar 12 is molded around degradable insert member 14, and completely encloses member 14, as is shown in FIGS. 1 and 2. Insert member 14 is generally centrally located in positionally fixed location with soap bar 12.

Thus, degradable insert member 14 is positionally placed equally distant from opposing vertically displaced soap bar surfaces 16 and 18, and further includes a center point equally distant between opposing laterally displaced soap bar surfaces 20 and 22. Thus, prior to use, degradable insert member 14 is centrally located in a positionally fixed location with soap bar 12.

Of extreme importance to the inventive concept, as is herein described, insert member 14 is formed of an environmentally degradable composition. In particular, insert member 14 is formed of a degradable plastic composition which will predictably environmentally decompose to some type of a powder or liquid form and may eventually be encompassed in the natural environment. In general, degradable plastic compositions are degraded through the mechanisms of biodegradation, solubility, and photodegradation.

In one form of the invention, insert member 14 may be formed of a biodegradable composition which, due to its chemical structure, is generally acceptable to being assimilated by microorganisms, such as fungi, and bacteria through enzyme action. However, this degradable mechanism in general requires heat, oxygen, as well as moisture. Some naturally current polymers, such as cellulose and natural rubber, are attacked by a multiplicity of fungi and bacteria. Some synthetic polymer deterioration has shown that various plastic compositions are attacked by microorganisms, however, the time span for both the naturally occuring polymers and the synthetic plastic compositions is generally lengthy and may not be applicable to a quick disposal technique.

In the preferred concept of the invention, as is herein described, insert member 14 is formed from a water soluble plastic composition. In particular, the water soluble plastic composition may be a composition selected from the group consisting of polyvinyl alcohol, hydroxypropyl cellulose, and polyethylene oxide. The solubility of various plastic compositions will vary in a considerable amount with the type of plastic formulation, temperature, solving concentration, as well as solvent itself. However, for the purposes as is herein described, and the compositions as hereinbefore provided, the solvent is water.

Hydroxypropyl cellulose, for example, when immersed in water forms a slippery gel on the outer surface. The gel layer dissolves and washes away before the water penetrates progressively deeper to dissolve the complete item. As is known in this art, various additives such as fillers, plasticizers, and lubricants tending to wick or absorb water through the outer gel layer may speed up the overall rate of solution.

As is readily evident, the use of a water soluble plastic composition as has hereinbefore been described, promotes the disposal of the insert member 14 subsequent to use. The user may simply immerse insert member 14 into the sink and pass water around such. In this manner, insert member 14 will easily dissolve and may be flushed down the drain in the normal mode of operation.

The solubility of various water soluble plastic compositions will vary with the particular formulations, molecular weight and temperature. For example, hydroxypropyl cellulose has been found to be insoluble in water temperatures above 45° C. Polyethylene oxide is insoluble in water temperatures above 65° C. Generally, these are within the normal ranges of sink water and such would not present a problem in the solubility of these water soluble plastic compositions.

Due to the fact that such compositions would be maintained in a relatively dry state during use of the soap bar 12, insert member 14 will provide the frame structure for soap bar 12 throughout its normal use. Only when soap bar 12 layers have been reduced sufficiently that moisture begins to act to dissolve insert member 14 will there be a manner and mode for disposing of the entire environmentally degradable soap bar system 10.

In general, the hereinbefore described water soluble plastic compositions are non-toxic, edible, non-caloric, non-nutritive, and generally will wash through the normal household plumbing without any damage or clogging. Such have been found to have a low biological oxygen demand, and do not support mold or bacteria growth. If placed into an incinerator system, such readily combusts and decomposes to carbon dioxide, water, and residual carbon.

Of importance in soap bar system 10 is the means for securing degradable insert member 14 to the surrounding soap bar 12 independent of wear orientation imposed on soap bar 12 during use. In general, where there is no mechanism for securing degradable plastic insert member 14 to the surrounding soap material, wear on one surface 16 or 18 down to the external surface of insert member 14 may dislodge insert member 14 from the remaining soap material of bar 12. This would have the effect of possibly creating a cavity within the remaining volume of soap material and cause increased disintegration of the soap material in predetermined areas thereby defeating one of the major advantages of creating soap bar system 10.

In order to maintain degradable insert member 14 in fixed securement with the surrounding soap material of bar 12, through openings 24 may be vertically formed as shown in FIGS. 1, 2 and 3. Thus, prior to formation or molding of soap bar 12 around insert member 14, a plurality of singularities or through openings 24 are formed in a predetermined pattern as shown. When soap bar 12 is molded into a final shape around insert member 14, the soap material fills through openings 24 internal to insert member 14. Thus, soap material on opposing vertical displaced sides of insert member 14 are joined each to the other by the soap material contained within the openings 24. In this manner, insert member 14 is secured and fastened to the surrounding soap material even when wear on one side of insert member 14 exceeds the wear on an opposing surface. It is noted, that even where one surface such as upper vertical surface 16 of soap bar 12 is worn down to upper insert surface 26, that the lower section soap material adjacent surface 18 of soap bar 12 would be maintained in contact with insert member 14 through the bonding supplied by the soap material formed through openings 24.

In similar manner as shown in FIG. 4, partial recesses 28 may be formed on upper and lower surfaces of insert member 14 to provide bonding of member 14 to the surrounding soap material in an advantageous manner.

When a large amount of the soap material has been removed from soap bar 12 of soap bar system 10, it is possible that portions of insert member 14 may extend external to the remaining volume of soap material. Thus, insert member 14 is contoured to include a blunt peripheral wall boundary having a substantial radius of curvature at end points in order to minimize any sharp edges of insert member 14. This is important, since once insert member 14 is exposed, such may be rubbed or otherwise interfaced with the body of a user and if sharp edges are remaining, such may lead to injurious abrasive contact. As shown in FIG. 1, opposing lateral edges 30 and 32 of insert member 14 are rounded and include respective tapered sections 34 and 36. Additionally, rounded corner portions 38 are provided at the diagonal corner sections of member 14. In this manner, insert member 14 may be rubbed or otherwise contiguously interfaced with the skin surface of a user without the possibility of providing injurious contact.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. An environmentally degradable soap bar system comprising:

(a) a soap bar having a predetermined contour;

(b) an insert member formed of an environmentally degradable composition and positionally located internal said soap bar, said insert member being formed from a water soluble plastic composition selected from the group consisting of hydroxypropyl cellulose, and polyethylene oxide, said insert member being dissolved subsequent to said soap bar being worn away thereby exposing said insert member to the external environment; and, (c) means for securing said insert member to said soap bar independent of wear orientation imposed on said soap bar during use.

2. The environmentally degradable soap bar system as recited in claim 1 where said soap bar is formed of soap material molded around said insert member.

3. The environmentally degradable soap bar system as recited in claim 2 where said securement means includes at least one partial recess formed within said insert member, said soap material being molded internal said recess.

4. The environmentally degradable soap bar system as recited in claim 3 where said securement means includes at least one through opening formed through said insert member, said soap material being molded to substantially fill said through opening internal said insert member.

5. The environmentally degradable soap bar system as recited in claim 4 where said soap material is molded internal said through opening and external said insert member substantially in one piece formation.

6. The environmentally degradable soap bar system as recited in claim 1 where said insert member is contoured to include a blunt peripheral wall boundary, said wall boundary having a predetermined radius of curvature to minimize sharp edges of said insert member.

7. The environmentally degradable soap bar system as recited in claim 1 where said insert member is centrally located in a positionally fixed location within said soap bar.

8. The environmentally degradable soap bar system as recited in claim 1 where said insert member includes a volume contour similar in contour to said soap bar, said insert member being substantially centrally located within said soap bar.

* * * * *